US012529219B2

(12) United States Patent
Su et al.

(10) Patent No.: US 12,529,219 B2
(45) Date of Patent: Jan. 20, 2026

(54) POP-UP DRAIN LINKAGE DEVICE

(71) Applicant: Guangdong Meijie Faucet Company Limited, Dongguan (CN)

(72) Inventors: Zaijiang Su, Dongguan (CN); Jiabin Yang, Dongguan (CN)

(73) Assignee: GUANGDONG MEIJIE FAUCET COMPANY LIMITED, Dongguan (CN)

( * ) Notice: Subject to any disclaimer, the term of this patent is extended or adjusted under 35 U.S.C. 154(b) by 81 days.

(21) Appl. No.: 18/636,930

(22) Filed: Apr. 16, 2024

(65) Prior Publication Data

US 2024/0344308 A1 Oct. 17, 2024

Related U.S. Application Data

(60) Provisional application No. 63/459,755, filed on Apr. 17, 2023.

(51) Int. Cl.
*E03C 1/23* (2006.01)

(52) U.S. Cl.
CPC ..... *E03C 1/2302* (2013.01)

(58) Field of Classification Search
CPC ..... E03C 1/23; E03C 1/2302; A47K 1/14
USPC ..... 4/684, 689, 691, 692, 295
See application file for complete search history.

(56) References Cited

U.S. PATENT DOCUMENTS

2014/0310864 A1* 10/2014 Ye ..... E03C 1/2302 4/295

FOREIGN PATENT DOCUMENTS

CN 211395862 U * 9/2020

* cited by examiner

*Primary Examiner* — Tuan N Nguyen
(74) *Attorney, Agent, or Firm* — Ware, Fressola, Maguire & Barber LLP; Brian L. Wamsley

(57) ABSTRACT

A drain plug linkage device comprising; a pull rod assembly including a pull rod and pull rod connector, a link rod having adjustment teeth and square spaces between them along its height, and a lever member having adjustment holes along its length. The link rod and lever member are connected through an adjustment mechanism which contains a push button lever adjustment mechanism by which a specific adjustment hole can be selected and locked into place, and a push button link rod adjustment mechanism by which a specific by space between the teeth may be selected and locked into place, whereby a user can easily select both the effective length of the lever member and the effective height of the link rod following installation of the drain plug linkage device and thereby optimize efficient operation of the linkage device.

10 Claims, 4 Drawing Sheets

POP-UP DRAIN LINKAGE DEVICE

This application claims priority to U.S. provisional application Ser. No. 63/459,755, filed Apr. 17, 2023.

FIELD OF THE INVENTION

The present invention relates to the technical field of drain, a drain device for example for a bathroom pool, bathtub, washbasin or hand-washing sink, and more particularly to a drain plug linkage device for a pop-up drain which can be assembled and adjusted rapidly.

BACKGROUND

A drain device is proposed for storing or discharging water in containers such as a bathroom pool, bathtub, washbasin or hand-washing sink. Such drain device is generally in the form of a drain plug linkage device. For instance, in a prior art drain device, the container is in communication with a drainpipe through an outlet and connected with one end of an operating rod such as a lever member, and the other end of a lever member is connected with a pull rod member extending downwards, so as to move the drain plug between positions of closing and opening the outlet by operating the pull rod member, realizing water storage or discharge in the containers like bathroom pool, tub, washbasin or hand-washing sink.

A number of drain plug linkage devices have been known, many of which are difficult to assemble and contain a number of small components that have to be mounted in a limited space. Moreover, the pull rod mechanisms have been made of rigid rod pieces, which results in a lack of degree of freedom during transition from a vertical lift movement of the drain plug by the lever action. In addition, difficulty occurs in mounting a locking nut by means of which the spherical part is directly and pivotably mounted in the pipe body of the discharge valve. Further, once a drain plug linkage device is installed it is typically difficult to adjust the interaction of the lever member, which is typically horizontal, with the vertical pull rod.

Therefore, there is need to improve the prior drain plug linkage devices, with advantages of simple and reliable assembly, easy adjustment and reliable operation of the lever member and pull rod of the drain plug linkage device.

SUMMARY OF THE INVENTION

It is thus the object of the present invention to provide a drain plug linkage device that can solve at least some of the aforesaid technical problems.

The primary object of the present invention is to provide an easy installation drain plug linkage device and its related parts. It is also an object of the invention to provide a drain plug linkage device that is easy and simple to adapt to the available space beneath a container such as a bathroom pool, bathtub, washbasin or hand-washing sink. It is a further object of the invention to provide a drain plug linkage device that is quick and easy to adjust to allow smooth and efficient operation of the drain plug.

According to an aspect of the present invention, a drain plug linkage device is provided, comprising a drain plug disposed in a pipe body, a pull rod assembly including a pull rod and pull rod connector, a link rod having adjustment teeth with spaces between them along its height, and a lever member having adjustment holes along its length. The link rod and lever member are connected through an adjustment mechanism which contains a push button lever adjustment mechanism by which a specific adjustment hole can be selected and locked into place, and a push button link rod adjustment mechanism by which a specific space between the teeth may be selected and locked into place, whereby a user can easily select both the effective length of the lever member and the effective height of the link rod following installation of the drain plug linkage device and thereby optimize efficient operation of the linkage device.

In the drain plug linkage device of the present invention, the relative position of the lever member and the link rod can be adjusted in a simple and convenient way, and it also can be securely retained by simple engagement of the adjustment mechanism into the space between the teeth. In this manner, the vertical movement of the pull rod assembly can be effectively converted to the lever motion of the lever member about a pivot point, being a spherical portion, so as to operate the drain plug to open or close a piping member.

In a preferred embodiment, the link rod includes a plurality of square teeth with square spaces between them and has the adjustment mechanism slidably mounted thereon. The lever member is configured to be inserted through a horizontal channel opening in the adjustment mechanism and includes a plurality of through holes. The adjustment mechanism is configured, when sliding along the link rod into the position of engaging with a square space between the teeth, to prevent the lever member from being axially displaced with respect to the teeth. Such as arrangement facilitates manufacturing of the link rod, lever member and adjustment mechanism.

In a preferred embodiment, the lever member is configured to be smoothly slidable through the adjustment mechanism which provides pivotal connection with the link rod. Not only can the vertical movement of the pull rod assembly be effectively converted to the lever motion of the lever member, but also rotation of the lever member around the longitudinal axis of the link rod can be reduced or avoided, such that an angle adjustment can be reduced or avoided when assembling the link rod.

In a specific embodiment, the adjustment mechanism comprises an adjustment slide having, a vertical channel through which the link rod in is inserted and locked into place, and an adjustment slide having a longitudinal channel through which the lever member is inserted and locked into place. The link rod is configured to be inserted through the vertical channel and the lever member is configured to be insertable through the longitudinal channel. The two adjustment slides are snapped, using snapping means, together to form the adjustment mechanism.

In a preferred embodiment the snapping means comprises a pair of elastically deformable tabs, each having a flange and press portion.

In another embodiment both the link rod adjustment slide and the lever member adjustment slide contain spring-loaded push-button tabs for locking the link rod and the lever member into place within their respective adjustment slides.

In a preferred embodiment the spring-loaded push-button-tab in the link rod adjustment slide comprises a square tab configured to fit into the spaces between the teeth of the link rod and thus lock the link rod within the link rod adjustment slide at a selected height.

In another preferred embodiment, the two push-buttons of the push-button tabs protrude through two holes in the lever member adjustment slide.

In yet another preferred embodiment, the outer cover of the lever member adjustment slide displays directional arrows to indicate which push-button provides vertical height adjustment of the link rod, and which push-button provides horizontal length adjustment of the lever member.

In a preferred embodiment the horizontal channel in the lever member adjustment slide has a height opening of about 50% to 100% of the height of the lever member to allow vertical movement of the lever member as defined by a pivot point with the adjustment slide.

In another preferred embodiment the lever member comprises a series of circular holes that are configured such that a circular tab of the lever member adjustment slide can be inserted and thus lock the lever member in the lever member adjustment slide.

In a preferred embodiment, the lever member is able to pivot around the circular tab of the lever member adjustment slide, as much as is permitted by the height of the horizontal channel.

The additional features and advantages of the present invention will partially become apparent to those of skill in the art upon reading the disclosure, and the others will be described in the following embodiments with reference to the accompanying drawings.

The present invention is described in detail below with reference to the accompanying drawings.

BRIEF DESCRIPTION OF THE DRAWINGS

The features, objects, and advantages of the invention will appear and can be further understood by reference to the following drawings. The present invention will be further described with reference to the specific embodiments illustrated in the figures, in which.

DETAILED DESCRIPTION OF THE INVENTION

Embodiments of the present invention will now be described, by way of example only, with reference to the accompanying drawings.

Figure 1:
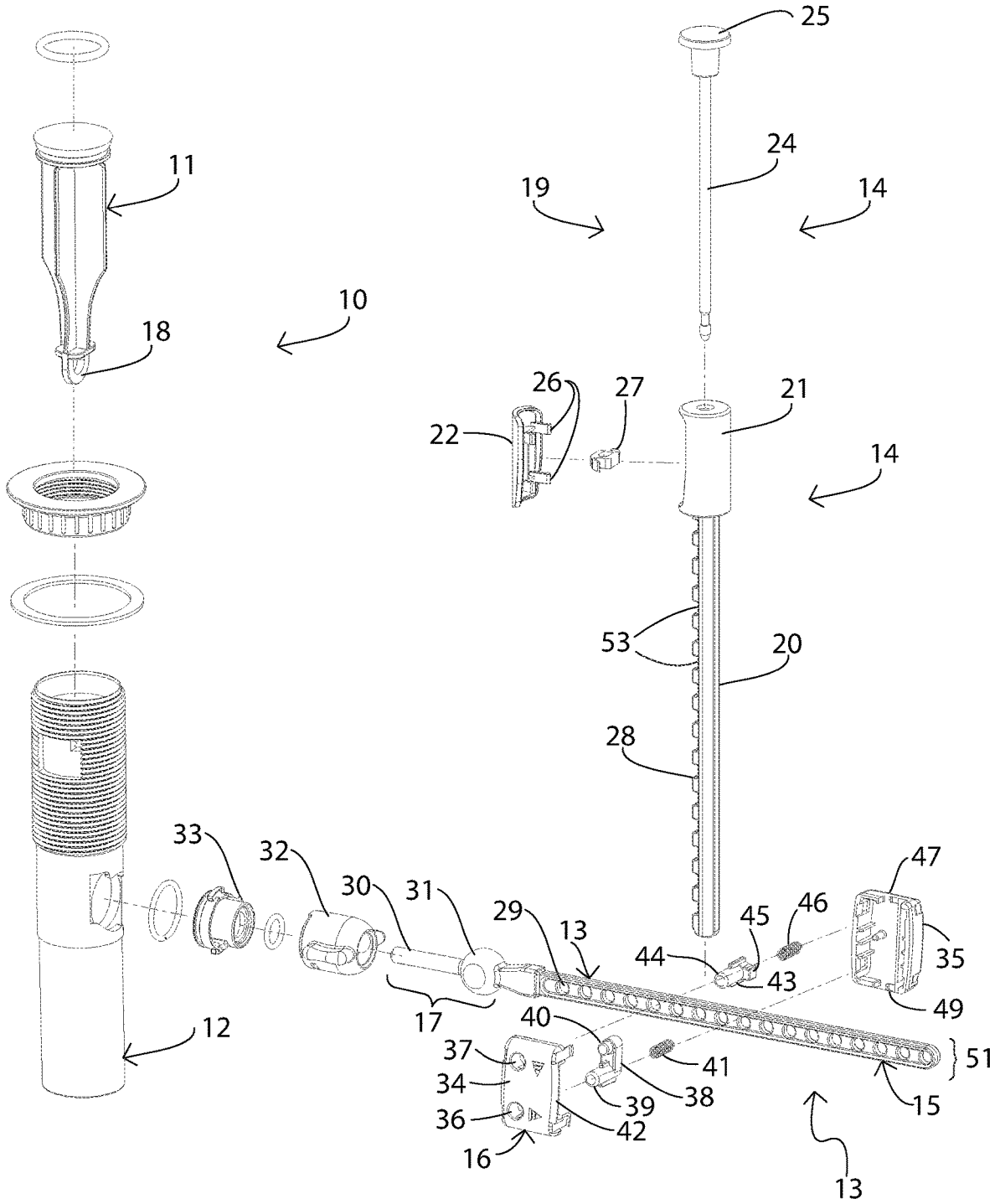
FIG. 1 illustrates an exploded view of an embodiment of the drain plug linkage device of the within invention.
Figure 2:
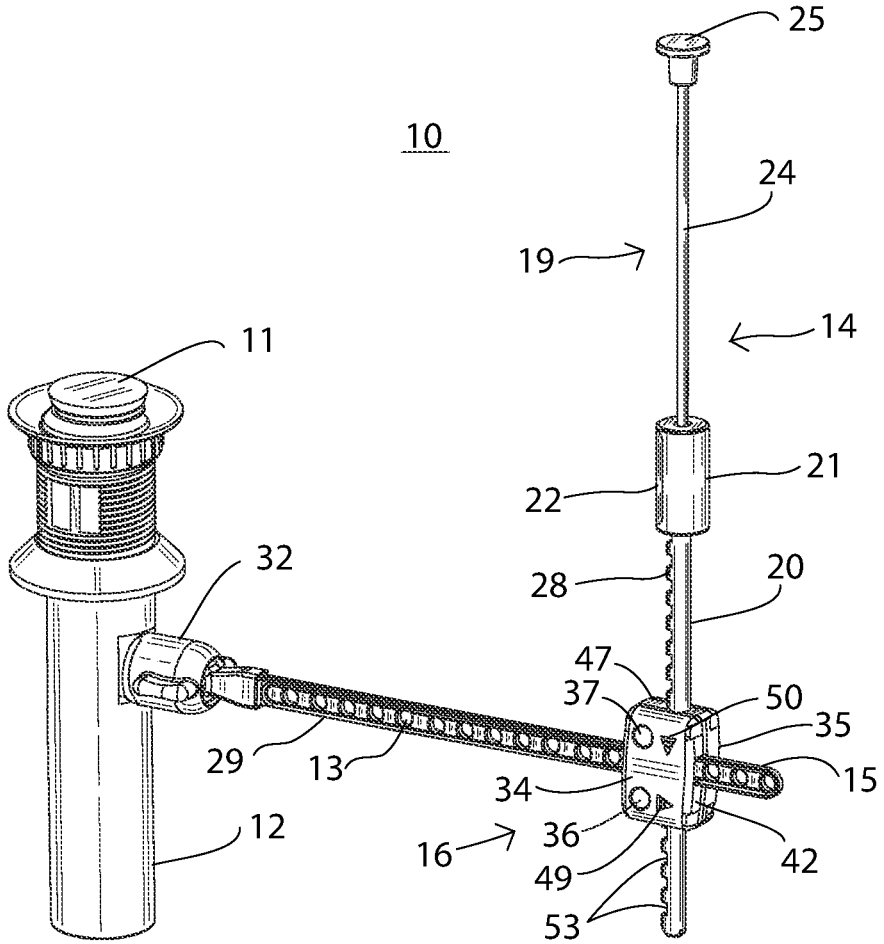
FIG. 2 illustrates an assembled view of the embodiment of the drain plug linkage device of FIG. 1.
Figure 3:
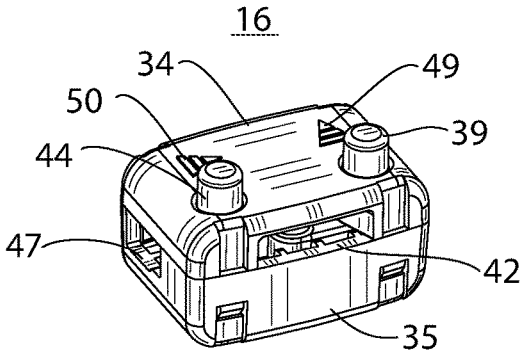
FIG. 3 illustrates a perspective top view of an embodiment an adjustment mechanism element of the drain plug linkage device of FIG. 1.
Figure 5:
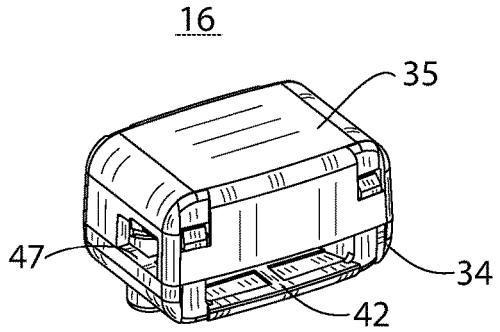
FIG. 5 illustrates a perspective bottom view of an embodiment an adjustment mechanism of the drain plug linkage device of FIG. 1.

Referring now to FIGS. 1 and 2, the drain plug linkage device 10 according to the present invention is generally shown, which mainly comprises a drain plug 11 at least partially disposed in a pipe body 12, such as a drainpipe, and configured to open or close a port of the pipe body 12, a lever member 13, and a pull rod assembly 14. The lever member 13 has a first end 15 operatively connected with the pull rod assembly 14 via an adjustment mechanism 16, and a second end 17 configured to operate opening and closing movement of the drain plug 11. In this embodiment, the second end 17 is inserted in aperture 18 formed on the bottom of drain plug 11. Aperture 18 has a size larger than second end 17 of lever member 13, such that the second end 17 and aperture 18 loosely fit with each other, but will still allow the performance of opening and closing movement of the drain plug 11 by means of second end 17 when lever member 13 acts in a lever motion. It is also conceivable of other fitting forms between second end 17 and aperture 18. For example, second end 17 has the same size as aperture 18, or is directly connected with a drain plug that does not have any aperture.

The pull rod assembly 14, according to an embodiment of the present invention, comprises a pull rod 19, a link rod 20 and a pull rod connector 21. As particularly shown in FIGS. 1 and 2, link rod 20 is operatively connected with lever member 13 via the adjustment mechanism 16. The pull rod connector 21 is disposed between pull rod 19 at an upper position and the lower link rod 20 at a lower position, and is utilized for coupling pull rod 19 with link rod 20. Pull rod 19 may comprise a pull rod body 24 and a pull rod head 25 connected with each other though threads or other means.

Particularly with reference to FIG. 1, a pull rod connector 21 according to an embodiment of the present invention is shown. Pull rod connector 21 may comprise a snap plate 22 having two protuberances 26 for removable connection, by being snapped into place, with the pull rod connector 21. An internal locking mechanism 27 located within pull rod connector 21, secures pull rod body 24 within pull rod connector 21 when locking member 27 is activated by depressing snap plate 22 into position on pull rod connector 21.

Link rod 20 is of a vertical length sufficient to enable its adjustable connection with adjustment mechanism 16. Accordingly, link rod 20 comprises a plurality of teeth 28 for adjustment interaction with adjustment mechanism 16, as further described below. Link rod teeth 28 are generally square in shape but may also be beveled for case of engagement within adjustment mechanism 16.

Figure 4:
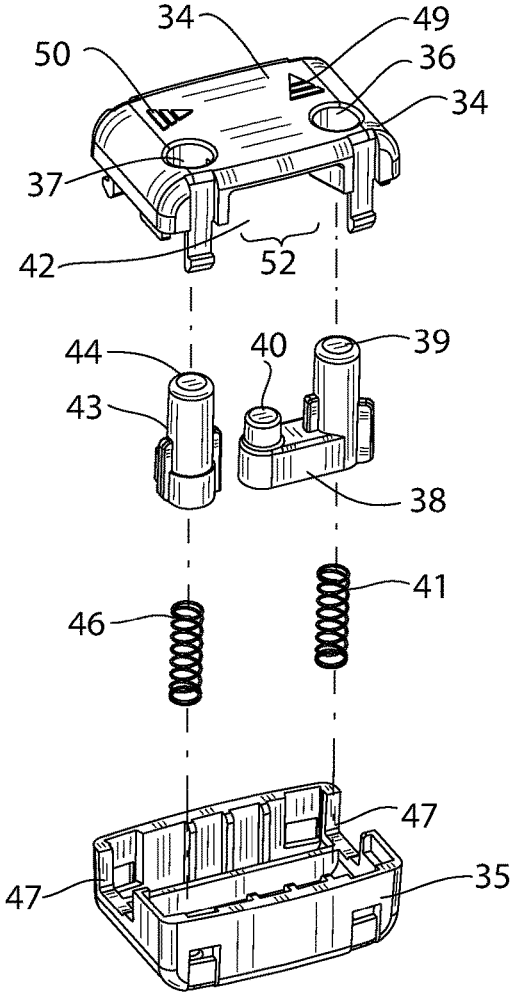
FIG. 4 illustrates a disassembled view of an embodiment an adjustment mechanism of the drain plug linkage device of FIG. 3.
Figure 6:
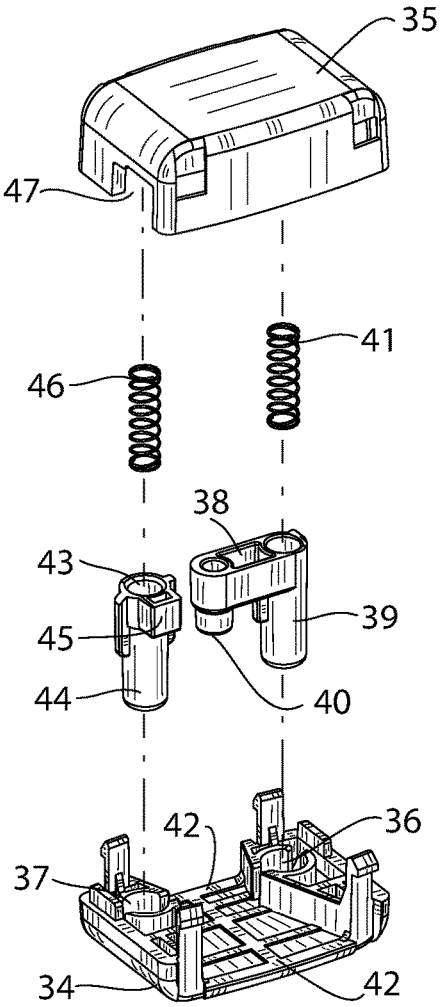
FIG. 6 illustrates a disassembled view of an embodiment an adjustment mechanism of the drain plug linkage device of FIG. 5.
Figure 7:
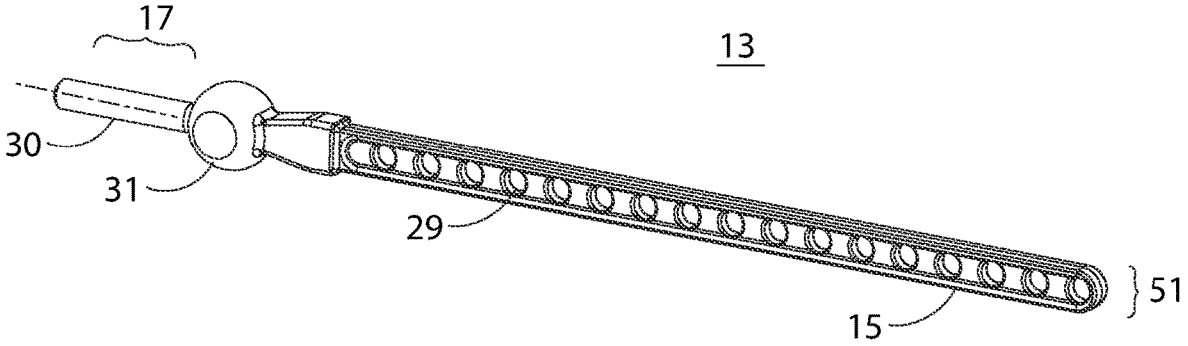
FIG. 7 illustrates a view of an embodiment of a lever member of the drain plug linkage device.
Figure 8A:
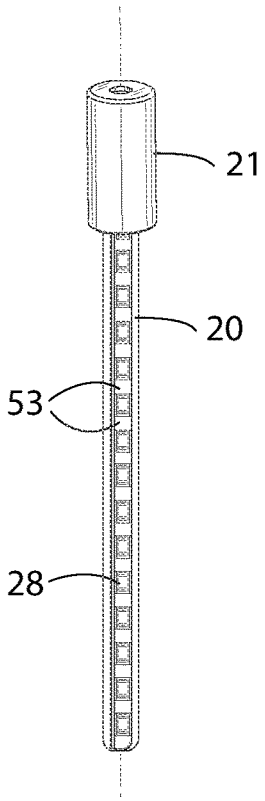
FIGS. 8*a* and 8*b* illustrate a front view and a side view, respectively, of an embodiment of a link rod of the plug linkage device of the within invention.
Figure 8B:
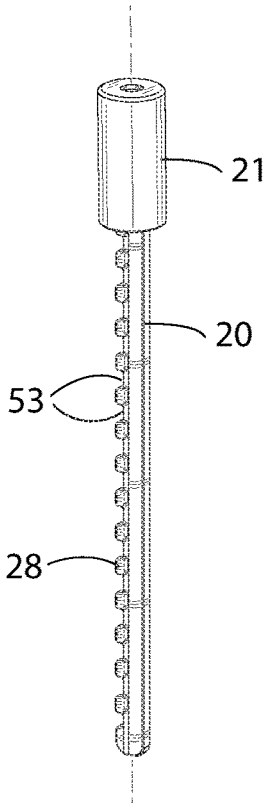

Adjustment mechanism 16 is designed for adjustably joining link rod 20 with lever member 13. Referring also to FIG. 7, lever member 13 is a horizontal member that adjustably connects along its length at its first end 15 with link rod 20 through adjustment mechanism 16 and joins with aperture 18 of drain plug 11 at its second end 17, which is inserted into aperture 18. Second end 17 comprises a rod 30 and a pivot 31, and is pivotally secured into pipe body 12 through pivot sleeve 32 that is connected to fastening sleeve 33. In this manner, the up or down motion of lever member 13 though pivot 31 causes drain plug 11 to correspondingly extend vertically or retract. Lever member 13 also provides a series of holes 29 for adjustable connection with adjustment mechanism 16. Further, lever member 13 has a height dimension 51 that is substantially less than the height 52 of channel 42 (FIG. 4), which allows for vertical pivotal movement of lever member 13 when engaged with adjustment mechanism 16 through lever channel 42 of first adjustment slide 34 during the operation of the linkage device of the within invention.

Referring also now to FIGS. 3-6, adjustment mechanism 16 comprises a first adjustment slide 34 and a second adjustment slide 35, that are snapped together to form adjustment mechanism 16. The first adjustment slide 34 allows for adjusting the effective length of lever member 13 while the second adjustment slide 35 allows for adjusting the effective length of link rod 20. First adjustment slide 34 comprises a first through hole 36 and a second through hole 37. A lever adjustment mechanism 38 comprises a first push button 39, that is movably inserted into through hole 36. Push button 39 operates adjustment mechanism 38, which can be returned to its original position by first spring 41 located at its base, after first push button 39 is depressed. Lever adjustment mechanism 38 also comprises a round tab 40 that is configured to fit into the adjustment holes 29 located along the length of lever member 13. See FIG. 7. When first push button 39 is depressed, lever member 13 becomes insertable through first adjustment slide 34 by means of a lever channel 42. When first push button 39 is released, lever adjustment mechanism 38 returns to its original position and round tab 40 becomes inserted into one of the adjustment holes 29 along the length of lever member 13, locking lever member 13 in a fixed-length position at adjustment mechanism 16. Further, lever channel 42 is configured to have a width 52 that is greater than height 51 of lever member 13, so that when lever member 13 is locked in a fixed position within adjustment slide 34, lever member 13 is nevertheless free to pivot vertically up and down with respect to round tab 40 to accommodate the motion of linkage assembly 14 when in operation of drain plug 11. Adjustment slide 34 also provides an adjustment indicator 49 which indicates to the user that push button 39 allows for the adjustment of the linkage device 10 horizontally, which means the effective length of lever member 13.

The second adjustment slide 35 allows for adjusting the effective vertical length of link rod 20. Second adjustment slide 35 comprises a link rod adjustment mechanism 43 having a second push button 44 that is movably inserted into through hole 37. Second push button 44 can be returned to its original position by second spring 46 located at its base, after second push button 44 is depressed. Link rod adjustment mechanism 44 also comprises a square tab 45 that is configured to fit into the substantially square spaces 53 between the adjustment teeth 28 located along the length of link rod 20. When push button 44 is depressed, link rod 20 becomes insertable through second adjustment slide 35 by means of a link rod channel 47. When second push button 44 is released, link rod adjustment mechanism 44 returns to its original position and square tab 45 becomes inserted into a substantially square space 53 between two of the adjustment teeth 28 along the length of link rod 20, locking link rod 20 in a fixed position at adjustment mechanism 16. Adjustment slide 34 also provides an adjustment indicator 50 which indicates to the user that push button 44 allows for the adjustment of the linkage device 10 vertically, which means the effective length of link rod 2

FIGS. 3-6 illustrate enlarged views of adjustment mechanism 16. In order to quickly and easily adjust the drain plug linkage device 10 after installation, the user simply depresses first push button 39 and aligns adjustment mechanism 16 to the desired length of lever member 13, and then releases first push button 39, thereby locking lever member 13 at the selected horizontal length. Then, the user depresses second push button 44 and aligns adjustment mechanism 16 to the desired height of link rod 20, and then releases second push button 44, thereby locking link rod 20 at the selected vertical height. This procedure can also be easily reversed if necessary.

The preceding preferred embodiments are illustrative of the practice of the invention. It is to be understood, however, that other expedients known to those of skill in the art, or disclosed herein, may be employed without departing from the spirit of the invention or the scope of the claims.

What is claimed is:

1. A drain plug linkage device, comprising:

a drain plug at least partially disposed in a pipe body, a pull rod assembly including a pull rod, a link rod and a pull rod connector for operatively connecting said pull rod with said link rod, said link rod being configured for adjustable connection with a lever member, a lever member having a first end configured for adjustable connection with said link rod and a second end extending into said pipe body and configured to operate the drain plug, an adjustment mechanism for adjustably connecting said link rod with said lever member, said adjustment mechanism comprising;

a first adjustable slide portion having a first channel for receiving said first end of said lever member, a second adjustable slide portion having a second channel for receiving a distal end of said link rod, and wherein said first and second adjustable slide portions are joined together, a lever adjustment mechanism located within said first adjustable slide portion for adjustably fixing said lever member within said adjustment mechanism, said lever adjustment mechanism comprising a first spring-loaded push button mechanism, said first spring-loaded push button mechanism comprising a first push button component and a first spring component affixed at a base of said first push button component, a link rod adjustment mechanism located within said second adjustable slide portion for adjustably fixing said link rod within said adjustment mechanism, said link rod adjustment mechanism comprising a second spring-loaded push button mechanism, said second spring-loaded push button mechanism comprising a second push button component and a second spring component affixed at a base of said second push button component, wherein the effective length of said lever member is selected by depressing said first spring-loaded push button mechanism, positioning said lever member by sliding said lever member through said first channel in said first adjustment slide and then releasing said first spring-loaded push button mechanism, and wherein the effective length of said link rod is selected by depressing said second button, positioning said link rod by sliding said link rod through said second channel in said second adjustment slide and then releasing said second spring-loaded push button.

2. The drain plug linkage device according to claim 1, wherein said link rod further comprises a series of teeth along its vertical length and having square spaces located between each of said teeth, said teeth and said square spaces being configured for adjustable connection with said lever member through said adjustment mechanism.

3. The drain plug linkage device according to claim 2, wherein said lever member further comprises a series of round holes along its length configured for adjustable connection with said link rod through said adjustment mechanism.

4. The drain plug linkage device according to claim 3, wherein said first push button component of said first spring-loaded push button mechanism located within said first adjustable slide portion further comprises a protruding round tab, said protruding round tab being configured to be insertable into any of said round holes of said lever member.

5. The drain plug linkage device according to claim 4, wherein said second push button component of said second spring-loaded push button mechanism located within said second adjustable slide portion further comprises a protruding square tab, said protruding square tab being configured to be insertable into any of said square spaces between said teeth of said link rod.

6. The drain plug linkage device according to claim 5, wherein said first spring-loaded push button and said second spring-loaded push button are returned to their original positions after being pushed.

7. The drain plug linkage device according to claim 4, wherein said first channel is a horizontal channel and said second channel is a vertical channel.

8. The drain plug linkage device according to claim 7, wherein said horizontal first channel of said first adjustable slide portion of said adjustment mechanism further comprises a channel height dimension and said lever member further comprises a lever height dimension, wherein said lever height dimension is substantially less than said channel height dimension.

9. The drain plug linkage device according to claim 8 wherein said first adjustable slide portion of said adjustment mechanism is configured such that said lever member is pivotally moveable about said protruding round tab of said first push button component of said first spring-loaded push button mechanism when said protruding round tab is inserted into a round hole of said lever member.

10. A drain plug linkage device, comprising;

a drain plug at least partially disposed in a pipe body, a pull rod assembly including a pull rod, a link rod and a pull rod connector for operatively connecting said pull rod with said link rod, wherein said link rod comprises a series of teeth along its vertical length and having square spaces located between each of said teeth, said link rod being configured for adjustable connection with a lever member, a lever member having a first end configured for adjustable connection with said link rod and a second end extending into said pipe body and configured to operate the drain plug, said lever member comprising a series of round holes along its length configured for adjustable connection with said link rod, an adjustment mechanism for adjustably connecting said link rod with said lever member, said adjustment mechanism comprising;

a first adjustable slide portion comprising a horizontal channel for receiving said first end of said lever member, a second adjustable slide portion comprising a vertical channel for receiving a distal end of said link rod, and wherein said first and second adjustable slide portions are immovably joined together, a lever adjustment mechanism located within said first adjustable slide portion for adjustably fixing said lever member within said adjustment mechanism, said lever adjustment mechanism comprising a first spring-loaded push button mechanism comprising a first push button member, a first spring member connected thereto, and a protruding round tab for pivotal connection with said lever member, a link rod adjustment mechanism located within said second adjustable slide portion for adjustably fixing said link rod within said adjustment mechanism, said link rod adjustment mechanism comprising a second spring-loaded push button mechanism comprising a second push button member, a second spring member connected thereto, and a protruding square tab for connection with said link rod, wherein the effective length of said lever member is selected by depressing said first button, positioning said lever member by sliding said lever member through said horizontal channel in said first adjustment slide and then releasing said first button, and wherein the effective length of said link rod is selected by depressing said second button, positioning said link rod by sliding it said link rod through said vertical channel in said second adjustment slide and then releasing said second button.

* * * * *